US009031250B2

(12) United States Patent
Ookuri et al.

(10) Patent No.: US 9,031,250 B2
(45) Date of Patent: May 12, 2015

(54) SIGNAL PROCESSING DEVICE AND SIGNAL PROCESSING METHOD

(75) Inventors: Kazunobu Ookuri, Kanagawa (JP); Kohei Asada, Kanagawa (JP); Tetsunori Itabashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 378 days.

(21) Appl. No.: 13/462,977

(22) Filed: May 3, 2012

(65) Prior Publication Data

US 2012/0308022 A1 Dec. 6, 2012

(30) Foreign Application Priority Data

Jun. 6, 2011 (JP) ..... 2011-126125

(51) Int. Cl.
*G10K 11/16* (2006.01)
*G10K 11/178* (2006.01)

(52) U.S. Cl.
CPC ..... *G10K 11/178* (2013.01); *G10K 2210/1081* (2013.01); *G10K 2210/3051* (2013.01); *G10K 2210/1053* (2013.01)

(58) Field of Classification Search
CPC ..... A61F 11/06; G10K 11/16
USPC ..... 381/71.1–71.7, 71.9–71.1
See application file for complete search history.

(56) References Cited

U.S. PATENT DOCUMENTS

| | | | | |
|---|---|---|---|---|
| 8,073,151 | B2 * | 12/2011 | Joho et al. | 381/71.6 |
| 8,085,951 | B2 * | 12/2011 | Trautmann et al. | 381/101 |
| 8,355,513 | B2 * | 1/2013 | Burge et al. | 381/71.6 |
| 8,532,310 | B2 * | 9/2013 | Gauger et al. | 381/71.6 |
| 2002/0122518 | A1 | 9/2002 | Yasuda et al. | |
| 2002/0181714 | A1 * | 12/2002 | Proudler | 381/57 |
| 2008/0212791 | A1 | 9/2008 | Asada et al. | |
| 2010/0195844 | A1 | 8/2010 | Christoph et al. | |
| 2011/0007907 | A1 * | 1/2011 | Park et al. | 381/71.8 |
| 2012/0155666 | A1 * | 6/2012 | Nair | 381/71.6 |
| 2012/0310636 | A1 | 12/2012 | Ookuri et al. | |
| 2012/0314881 | A1 * | 12/2012 | Burge et al. | 381/71.1 |

FOREIGN PATENT DOCUMENTS

| | | | |
|---|---|---|---|
| EP | 2 262 279 | A1 | 12/2010 |
| JP | 07-212190 | A | 8/1995 |
| JP | 2002-158619 | A | 5/2002 |
| JP | 2008-193421 | A | 8/2008 |
| JP | 2009-033309 | A | 2/2009 |
| JP | 2011-019209 | A | 1/2011 |

* cited by examiner

*Primary Examiner* — Disler Paul
(74) *Attorney, Agent, or Firm* — Wolf, Greenfield & Sacks, P.C.

(57) ABSTRACT

There is provided a signal processing device s including a noise cancellation process clock generation unit configured to generate a noise cancellation process clock having a predetermined fixed frequency, a noise canceling unit configured to include a noise canceling filter operating based on the noise cancellation process clock and generating a noise canceling signal having a signal property of canceling an external noise component based on an input audio signal including the external noise component picked up by a microphone, and an addition unit superimposing the noise canceling signal generated by the filter on a digital audio signal, and a sampling rate conversion unit configured to rate-convert the input digital audio signal sampled at a clock in asynchrony with the noise cancellation process clock to a signal at a sampling frequency in synchrony with the noise cancellation process clock and to supply the rate-converted signal to the addition unit.

9 Claims, 10 Drawing Sheets

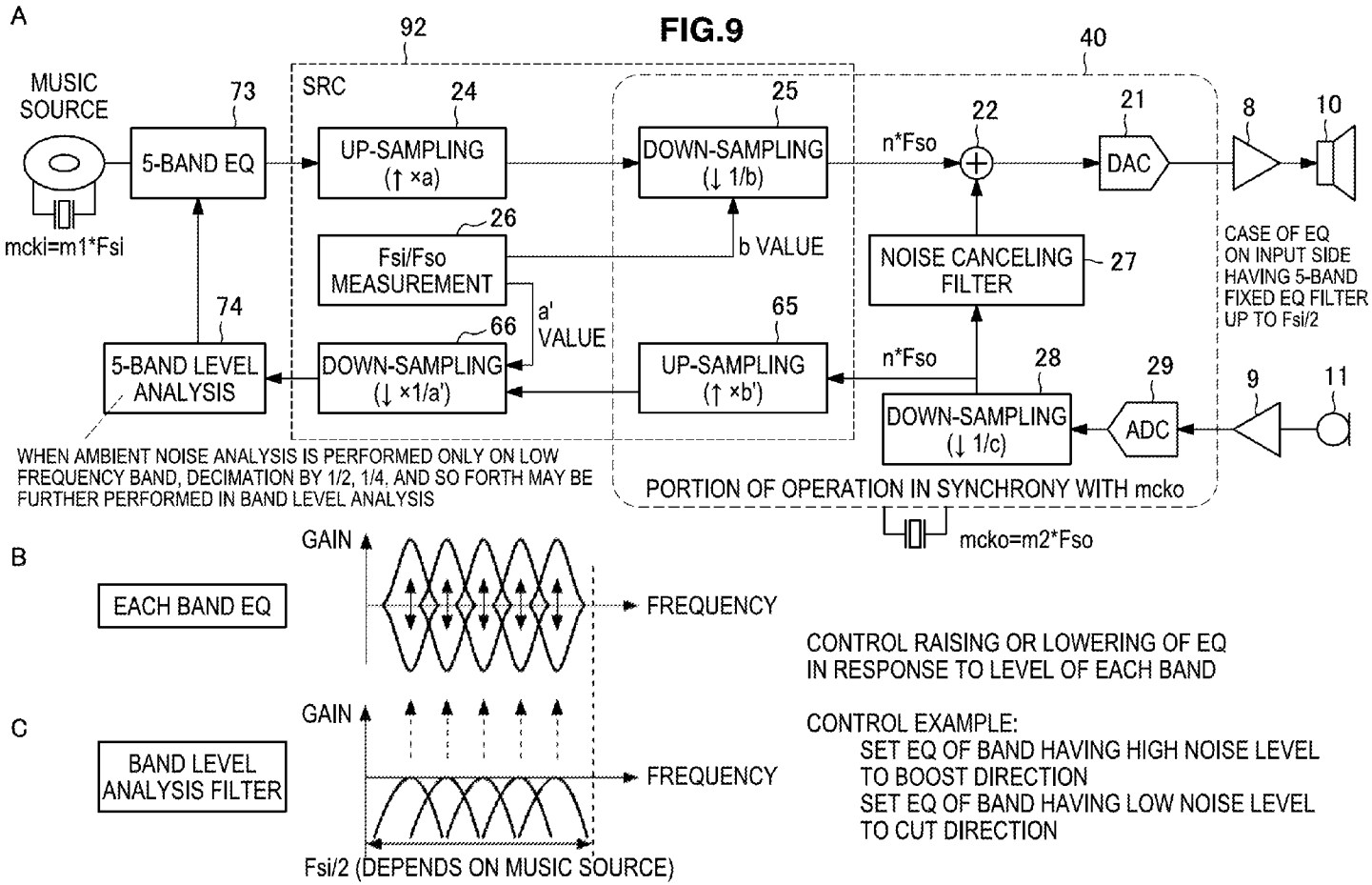
FIG.9
A
MUSIC SOURCE
mcki=m1*Fsi
73
5-BAND EQ
74
5-BAND LEVEL ANALYSIS
WHEN AMBIENT NOISE ANALYSIS IS PERFORMED ONLY ON LOW FREQUENCY BAND, DECIMATION BY 1/2, 1/4, AND SO FORTH MAY BE FURTHER PERFORMED IN BAND LEVEL ANALYSIS
92
SRC
24
UP-SAMPLING (↑ ×a)
26
Fsi/Fso MEASUREMENT
66
DOWN-SAMPLING (↓ ×1/a')
a' VALUE
25
DOWN-SAMPLING (↓ 1/b)
b VALUE
65
UP-SAMPLING (↑ ×b')
n*Fso
22
40
21
DAC
8
10
CASE OF EQ ON INPUT SIDE HAVING 5-BAND FIXED EQ FILTER UP TO Fsi/2
27
NOISE CANCELING FILTER
n*Fso
28
DOWN-SAMPLING (↓ 1/c)
29
ADC
9
11
PORTION OF OPERATION IN SYNCHRONY WITH mcko
mcko=m2*Fso
B
GAIN
FREQUENCY
EACH BAND EQ
CONTROL RAISING OR LOWERING OF EQ IN RESPONSE TO LEVEL OF EACH BAND
C
GAIN
FREQUENCY
BAND LEVEL ANALYSIS FILTER
Fsi/2 (DEPENDS ON MUSIC SOURCE)
CONTROL EXAMPLE:
SET EQ OF BAND HAVING HIGH NOISE LEVEL TO BOOST DIRECTION
SET EQ OF BAND HAVING LOW NOISE LEVEL TO CUT DIRECTION

SIGNAL PROCESSING DEVICE AND SIGNAL PROCESSING METHOD

BACKGROUND

The present disclosure relates to a signal processing device that performs a signal process on a digital audio signal output to a sound reproduction device such as so-called headphones or earphones, and in particular, to a signal processing device and a method for the same that can perform a noise cancellation process regardless of a sampling frequency of the digital audio signal.

Techniques of converting a sampling frequency of a digital audio signal to an arbitrary sampling frequency are disclosed in Japanese Laid-Open Patent Publication No. 2002-158619 and Japanese Laid-Open Patent Publication No. H07-212190. A technique of causing a digital circuit to cancel external noises heard when audio signals of content such as a musical composition are reproduced by a headphone device is disclosed in Japanese Laid-Open Patent Publication No. 2008-193421.

The audio signal is reproduced from a music medium, for example, from a recording medium such as a compact disc (CD) and a digital versatile disc (DVD), or is input to an optical cable or a coaxial cable by a Sony Philips Digital Interface (SPDIF) or input to a signal processing device, and so forth by wireless communication such as Bluetooth. The signal processing device then performs, for example, a noise cancellation process, and so forth on the audio signal, and the audio signal processed by the signal processing device is then supplied to and reproduced in a music reproduction device such as headphones.

SUMMARY

The sampling frequency of the audio signal supplied from these music sources has various values such as 32 kHz, 44.1 kHz, 48 kHz, 96 kHz, and so forth. It is thus necessary for the signal processing device to process the audio signals in response to the various sampling frequencies. For example, in order to process the audio signals having different sampling frequencies, it is necessary to change filter coefficients of the signal processing device for each sampling frequency.

As a result, a processing load may be increased, and the system may also be stopped and restarted once due to the change in filter coefficient.

In addition, most signal processing devices reproduce a clock as a reference from the received audio signal and operate in synchrony with the clock. However, in this case, it is difficult to realize a signal processing device that does not need to change internal coefficients even when the sampling frequencies are changed with respect to the audio signals having different sampling frequencies within the signal processing device.

In light of the above, the present disclosure is made to provide a signal processing device that does not need to change internal coefficients or the like so as to match sampling frequencies of the audio signals.

According to an embodiment of the present disclosure, there is provided a signal processing device which includes: a noise cancellation process clock generation unit configured to generate a noise cancellation process clock having a predetermined fixed frequency; a noise canceling unit configured to include a noise canceling filter operating based on the noise cancellation process clock and generating a noise canceling signal having a signal property of canceling an external noise component based on an input audio signal including the external noise component picked up by a microphone, and an addition unit superimposing the noise canceling signal generated by the filter on a digital audio signal; and a sampling rate conversion unit configured to rate-convert the input digital audio signal sampled at a clock in asynchrony with the noise cancellation process clock to a signal at a sampling frequency in synchrony with the noise cancellation process clock and to supply the rate-converted signal to the addition unit.

For example, the sampling rate conversion unit includes: an up-sampling unit configured to raise the sampling frequency of the input digital audio signal; and a down-sampling unit configured to lower the sampling frequency raised by the up-sampling unit to a frequency based on the noise cancellation process clock.

According to another embodiment of the present disclosure, there is provided a signal processing method which includes: generating a noise cancellation signal having a signal property of canceling an external noise component based on an input audio signal including the external noise component picked up by a microphone in a filtering process based on a noise cancellation process clock having a predetermined fixed frequency; rate-converting an input digital audio signal sampled at a clock in asynchrony with the noise cancellation process clock to a signal having a sampling frequency in synchrony with the noise cancellation process clock; and adding the noise cancellation signal to the rate-converted digital audio signal.

According to the present disclosure, even when sampling frequencies of the audio signals are different due to a difference in a music source, the sampling frequencies are converted to frequencies of a noise cancellation process clock of the signal processing device side and are processed in a noise cancellation unit, thus removing the necessity to change the filter coefficients or the like of the noise cancellation unit.

According to the embodiments of the present disclosure described above, whenever a sampling frequency of an input audio signal is different, the signal processing device does not need to change an internal coefficient or the like or does not need to be restarted due to the change in internal coefficient, and it is thus possible to reduce processing loads and realize efficient operations.

BRIEF DESCRIPTION OF THE DRAWINGS

FIG. 9 is a diagram illustrating a fifth embodiment; and

DETAILED DESCRIPTION OF THE EMBODIMENT(S)

Hereinafter, embodiments of the present disclosure will be described in the following order.

<1. Description of Specific Conditions Resulting in Embodiments>

<2. First Embodiment>

<3. Second Embodiment>

<4. Third Embodiment>

<5. Fourth Embodiment>

<6. Fifth Embodiment>

<7. Sixth Embodiment>

<1. Description of Specific Situations Resulting in Embodiments>

First, specific situations resulting in the embodiments will be described prior to description of the embodiments.

Figure 1:
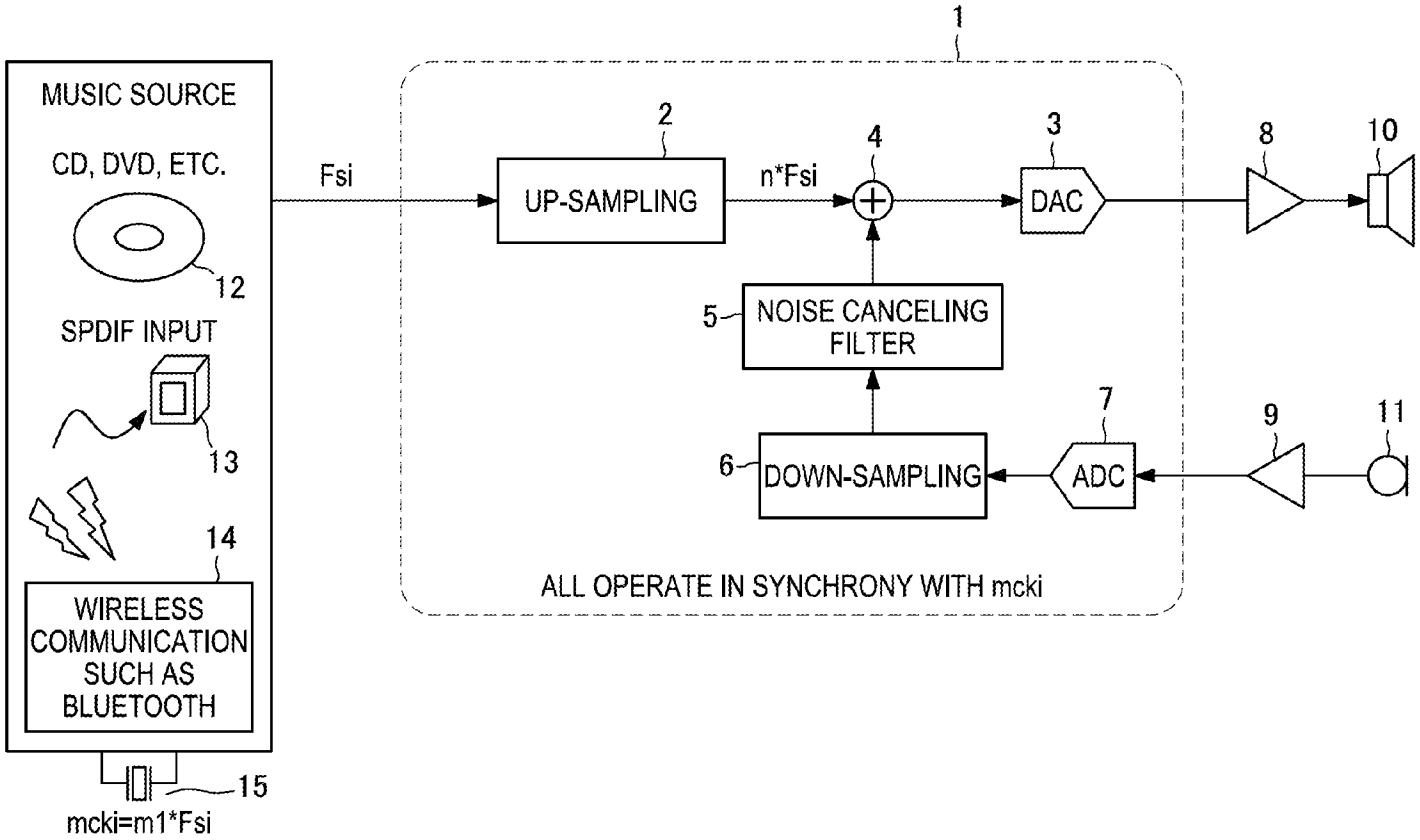
FIG. 1 is a diagram illustrating a specific example of a noise canceling operation.

FIG. 1 is a diagram illustrating an example of a signal processing device 1 carrying out a noise canceling operation.

A configuration of a noise canceling system shown in FIG. 1 is based on a feedforward method. However, a signal processing device according to an embodiment of the present disclosure is not limited to the feedforward method.

According to the feedforward method, an audio signal including picked-up external sounds (noises) is obtained, a suitable filtering process is carried out on the audio signal, and an audio signal for cancellation is generated. Then, according to the feedforward method, the audio signal for cancellation is synthesized with an audio signal to be reproduced. In the feedforward method, noise cancellation is attempted by outputting the synthesized audio signal from headphones or the like as a sound, thus negating the external sound.

Referring to FIG. 1, an outline of the noise canceling operation when sampling frequencies of a music source are different from each other will be described.

As shown in FIG. 1, for example, a compact disc (CD), a digital versatile disc (DVD) 12, a Sony Philips Digital Interface (SPDIF) 13, and wireless communication using Bluetooth 14 are present as music sources of digital audio signals. Various sampling frequencies of these music sources such as 32 kHz, 44.1 kHz, 48 kHz, and 96 kHz are present.

Digital audio signals are read from these music sources and input to the signal processing device 1 by a system operating at a master clock 15 mcki that is m1 (an integer) times the sampling frequency. The signal processing device 1 generates a master clock from the input digital audio signals, and operates using the generated clock as a reference (i.e., in synchrony with the generated clock).

The signal processing device 1 may include an up-sampling unit 2, a noise canceling filter 5, an addition unit 4, a down-sampling unit 6, a digital-to-analog conversion (DAC) unit 3, and an analog-to-digital conversion (ADC) unit 7.

The up-sampling unit 2 converts the input digital audio signal having a sampling frequency to a signal sampled at a higher sampling frequency n·Fsi. n is typically 4, 8, 16, and so forth. n is not set to one to prevent a signal oversampled by about 4 or higher from being used many times as an input to a delta sigma (ΔΣ) type DA converter and all of the signal processing operations of the noise cancellation from being delayed when the ΔΣ type DA converter is used as the DAC unit 3 in a subsequent stage.

A speaker 10 (diaphragm unit) having a diaphragm for reproducing the sound and a microphone 11 for picking up external noises are disposed in the headphones worn by a user.

In addition, in FIG. 1, the speaker 10 and the microphone 11 are illustrated to be disposed to correspond to any one between L and R channels.

The ADC unit 7 converts an analog signal picked up by the microphone 11 and amplified to a proper level by an amplifier 9 to a digital signal. The ADC unit 7 is, for example, a ΔΣ type 1-bit AD converter, and converts the analog signal to the digital signal having a very high sampling frequency such as 64·Fsi.

The microphone 11 picks up external sounds around the headphones (external noises) that are targets to be canceled. Here, although not shown, in a case of the feedforward method, it is actually common to dispose the microphone 11 on an external case of the headphones corresponding to each of R and L channels at which the speaker 10 is disposed.

The down-sampling unit 6 converts the digital signal sampled at a sampling frequency by the ADC unit 7 as a cancellation target to a signal sampled at a lower sampling frequency. In this case, the converted frequency matches the frequency converted by the up-sampling unit 2 (n·Fsi).

The nose canceling filter 5 receives an output from the down-sampling unit 6 as an input, and generates and outputs a digital signal (audio signal for cancellation) of a sound having a function of canceling the external sound. The simplest signal as the audio signal for cancellation is, for example, a signal having a phase opposite to a phase of a signal acquired by picking up the external sound. Moreover, a property considering transfer characteristics of a circuit, a space, and so forth is actually reflected in a noise canceling system.

In addition, the audio signal for cancellation passes through a filter, and the unnecessary signal of several kHz or higher is thus removed.

The addition unit 4 superimposes the audio signal for cancellation output from the noise canceling filter 5 on the digital audio signal output from the up-sampling unit 2. As a result, the digital audio signal and the audio signal for cancellation are synthesized to obtain a synthesized digital audio signal.

The synthesized digital audio signal is input to the DAC unit 3, converted to an analog signal, amplified by the amplifier 8, and reproduced as an audible sound by the speaker 10.

The reproduced sound is a synthesized sound that has a sound component of the music source and a sound component of the audio signal for cancellation, but has an effect of negating (canceling) the external sound arriving at ears from outside by means of the sound component of the audio signal for cancellation. As a result, the sound heard by a listener wearing the headphones is a sound of which the music source is relatively emphasized by canceling the external sound.

The description above is the outline of the noise canceling operation. Here, the noise canceling filter 5 of FIG. 1 has a filter property of removing an unnecessary signal of several kHz or higher. However, when the sampling frequencies of the digital audio signal are different due to a kind of the music source, it is accordingly necessary to adjust a cut-off frequency of the filter.

Figure 2:
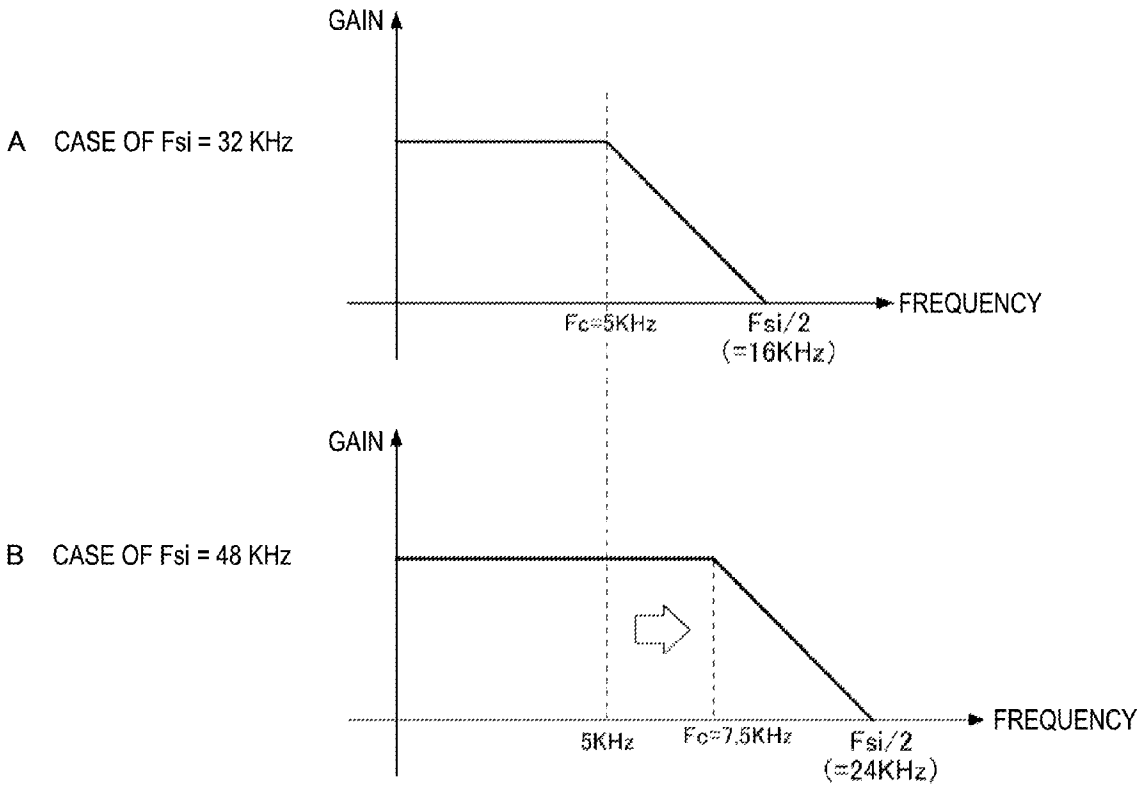
FIG. 2 is a diagram illustrating a change in filter property due to a difference in sampling frequency.

FIG. 2 is a diagram illustrating that cut-off frequencies are different due to the difference in sampling frequency of the music source. (A) of FIG. 2 illustrates the filter property when the sampling frequency is 32 kHz. In this case, the cut-off frequency is 5 kHz. On the other hand, (B) of FIG. 2 illustrates the filter property when the sampling frequency is 48 kHz. In this case, the cut-off frequency is 7.5 kHz.

When the sampling frequencies of the digital audio signal are thus different due to the difference in a music source, the cut-off frequency of the noise canceling filter 5 needs to be adjusted. In other words, when the music source input so as to be heard with the speaker 10 is changed or the sampling frequency Fsi of the digital audio signal is changed, filter coefficients of the noise canceling filter 5 need to be changed. In this case, the system needs to be stopped once, the filter coefficients of the noise canceling filter 5 need to be reset, and the system needs to be restarted.

<2. First Embodiment>

The embodiments of the present disclosure do not require such a process. That is, even when the sampling frequency of the digital audio signal Fsi is changed, the filter coefficients of the noise canceling filter 5 do not need to be changed, and it is possible to realize a suitable noise cancellation process.

Figure 3:
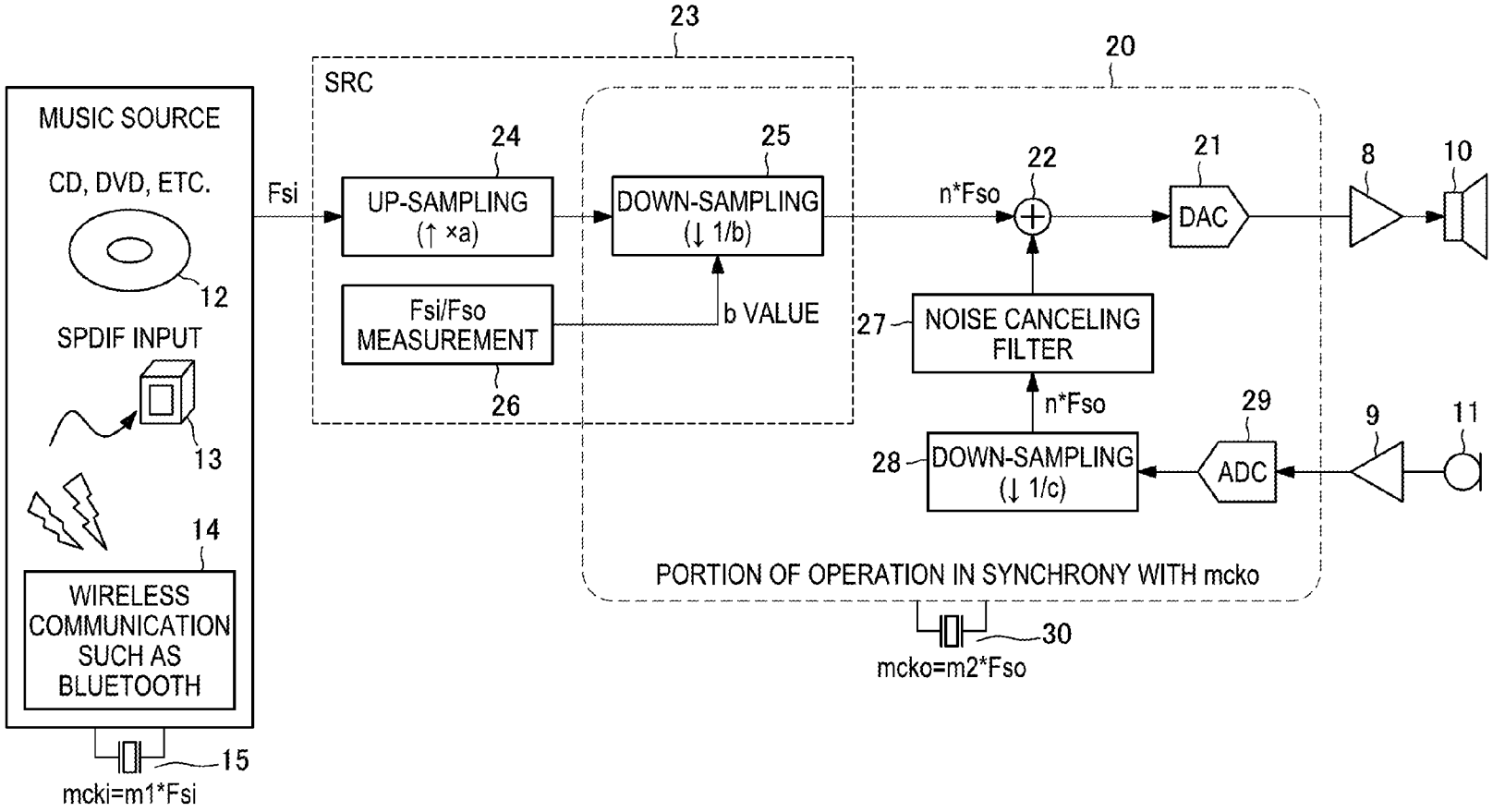
FIG. 3 is a diagram illustrating a first embodiment.

FIG. 3 is a diagram illustrating a signal processing device 20 according to the first embodiment.

Hereinafter, the same portions as those already described are denoted with the same reference symbols, and the redundant description is omitted.

The signal processing device 20 itself of the present embodiment has a master clock 30, and performs a noise cancellation process in synchrony with the master clock 30. It is assumed that the frequency of the master clock 30 is a frequency mcko that is m2 (an integer) times the sampling frequency Fso. The sampling frequency Fso is any one of 32 kHz, 44.1 kHz, 48 kHz, and 96 kHz, and is different from the frequency Fsi.

As shown in FIG. 3, the signal processing device 20 may include a sampling rate conversion (SRC) unit 23, a noise canceling filter 27, an addition unit 22, a down-sampling unit 28, a DAC unit 21, an ADC unit 29, and a master clock unit 30.

The SRC unit 23 may include an up-sampling unit 24, a down-sampling unit 25, and an Fsi/Fso measurement unit 26.

The SRC unit 23 converts the digital audio signal sampled at the sampling frequency Fsi from the music source to a digital audio signal sampled at a sampling frequency n·Fso at which the digital audio signal can operate in synchrony with the master clock 30 of the signal processing device 20. Since the sampling frequency of the digital audio signal from the music source is Fsi, the sampling frequency is not synchronous with the master clock of the signal processing device 20 as it is and thus does not result in a normal operation.

First, the up-sampling unit 24 converts the digital audio signal from the music source to a signal sampled at a sampling frequency higher than the sampling frequency of the digital audio signal. Here, conversion by about 256 (256·Fsi) is carried out. The down-sampling unit 25 then converts the digital audio signal converted to the signal sampled at the higher sampling frequency to a signal sampled at a lower sampling frequency n·Fso.

As disclosed in Japanese Laid-Open Patent Publication No. H07-212190, the SRC unit 23 specifies a resampling point for resampling the signal input at an input sampling rate Fsi using a frequency ratio of Fsi/Fso at an output sampling rate n·Fso. This frequency ratio may be obtained by the Fsi/Fso measurement unit 26. In particular, when the cycle of Fso is Tso, the period of N.Tso may be obtained by counting of the counter operating at mcki. Here, N is, for example, $2^{16}$ (=65536) or the like, and sampling rate conversion may be performed by having a high value of N, and averaging and removing jitter components included in Fsi or mcki. Conversion to the sampling rate of n·Fso is performed by accumulating the counted frequency ratios, generating a resampling point of n·Fso, generating a 256·Fsi sampling signal immediately before and after the resampling point of n·Fso, and carrying out linear interpolation therebetween.

It is thus possible for the digital audio signal sampled at Fsi of the music source to operate under the master clock 30.

According to the operations of the SRC unit 23 described above, the sampling rate conversion is carried out by causing the sampling frequency of the input audio signal to match the sampling frequency n·Fso used for the noise cancellation process.

The speaker 10 (diaphragm unit) having a diaphragm for reproducing the sound and the microphone 11 for picking up external noises are disposed in the headphones worn by the user. The ADC unit 29 converts an analog signal that is picked up by the microphone 11 and is amplified to a proper level by the amplifier 9 to a digital signal. For example, the ADC unit 29 is a ΔΣ type 1-bit AD converter or the like, and converts an analog signal to a digital signal having a very high sampling frequency such as 64·Fso. The microphone 11 picks up external sounds (external noises) around the headphones having the speaker 10 as noise cancellation targets.

The down-sampling unit 28 converts the digital signal (corresponding to the external noise) sampled by the ADC unit 29 as a cancellation target to a signal sampled at the sampling frequency n·Fso. Operations of the SRC unit 23 described above are operations matching the sampling frequency n·Fso for the noise cancellation process.

As described above, the ADC unit 29 and the down-sampling unit 28 perform the external noise digitization process. That is, an input audio signal including the external noise component picked up by the microphone 11 is converted to a digital signal in synchrony with the frequency of the noise cancellation process clock, and is supplied to the noise canceling filter 27.

The noise canceling filter 27 performs a filtering process based on the clock (frequency: n·Fso) for a noise cancellation process generated from the master clock 30 having the frequency m2·Fso. The noise canceling filter 27 receives an output from the down-sampling unit 28 as an input, performs the filtering process on the input, and generates and outputs an audio signal of the sound (audio signal for cancellation) having a function of canceling the external noise. In addition, unnecessary signals of several kHz or higher are removed by the audio signal for cancellation.

The addition unit 22 superimposes the audio signal for cancellation output from the noise canceling filter 27 on the digital audio signal output from the SRC unit 23. The digital audio signal and the audio signal for cancellation are thus synthesized to obtain a digital audio signal.

The synthesized digital audio signal is input to the DAC unit 21, converted to an analog signal, amplified by the amplifier 8, and then reproduced as an audible sound by the speaker 10.

A noise cancellation unit is configured by the noise canceling filter 27 that generates a noise cancellation signal having a signal property of canceling the external noise described above and the addition unit 22 that superimposes the noise cancellation signal generated by the noise canceling filter on the digital audio signal.

The sound reproduced as described above has a sound component of the music source and a sound component of the audio signal for cancellation that are synthesized, but the sound component of the audio signal for cancellation causes an effect of negating (canceling) the external sound arriving at ears from outside to occur. As a result, as an audible sound that can be heard by the user wearing the headphones, the external sound is canceled and the sound of the music source is relatively emphasized.

The noise canceling operations described above are operations that typically use a higher sampling frequency such as n·Fso, but which cause a delay from the ADC unit 29 to the DAC unit 21 via the noise canceling filter 27 to be small. In this case, the sampling frequency of the digital audio signal output from the SRC unit 23 is also made to match the sampling frequency n·Fso.

As described above, all of the noise canceling filter 27, the addition unit 22, the down-sampling unit 28, the DAC unit 21, and the ADC unit 29 perform the noise canceling operation at a frequency of the master clock 30.

In particular, by means of the function of the noise canceling filter 27 that removes the unnecessary signal of several kHz or higher, the sampling frequency of the digital audio signal to be reproduced is converted to a signal having a sampling frequency based on Fso, and the signal as a target of the noise canceling filter 27 is a signal based on the sampling frequency of Fso.

The cut-off frequency of the filter property can thus have a fixed value without relying on the sampling frequency Fsi of the digital audio signal of the music source. That is, the process of replacing the filter coefficient is not necessary whenever the sampling frequency Fsi of the digital audio signal of the music source is changed, and the signal processing device that has a low processing load and an effective operation can be provided.

<3. Second Embodiment>

Next, the second embodiment will be described.

Hereinafter, portions that are already described are denoted with the same reference symbols, and the redundant description is omitted.

An example of the noise cancellation using an equalizer will be described with reference to FIG. 4 prior to description of the second embodiment.

The equalizer is audio equipment that changes the frequency characteristic of the audio signal, and cuts a low frequency-band in advance for proper music reproduction because the reproduction property of the low frequency-band is generally regarded as important in the headphones used for the noise cancellation.

Figure 4:
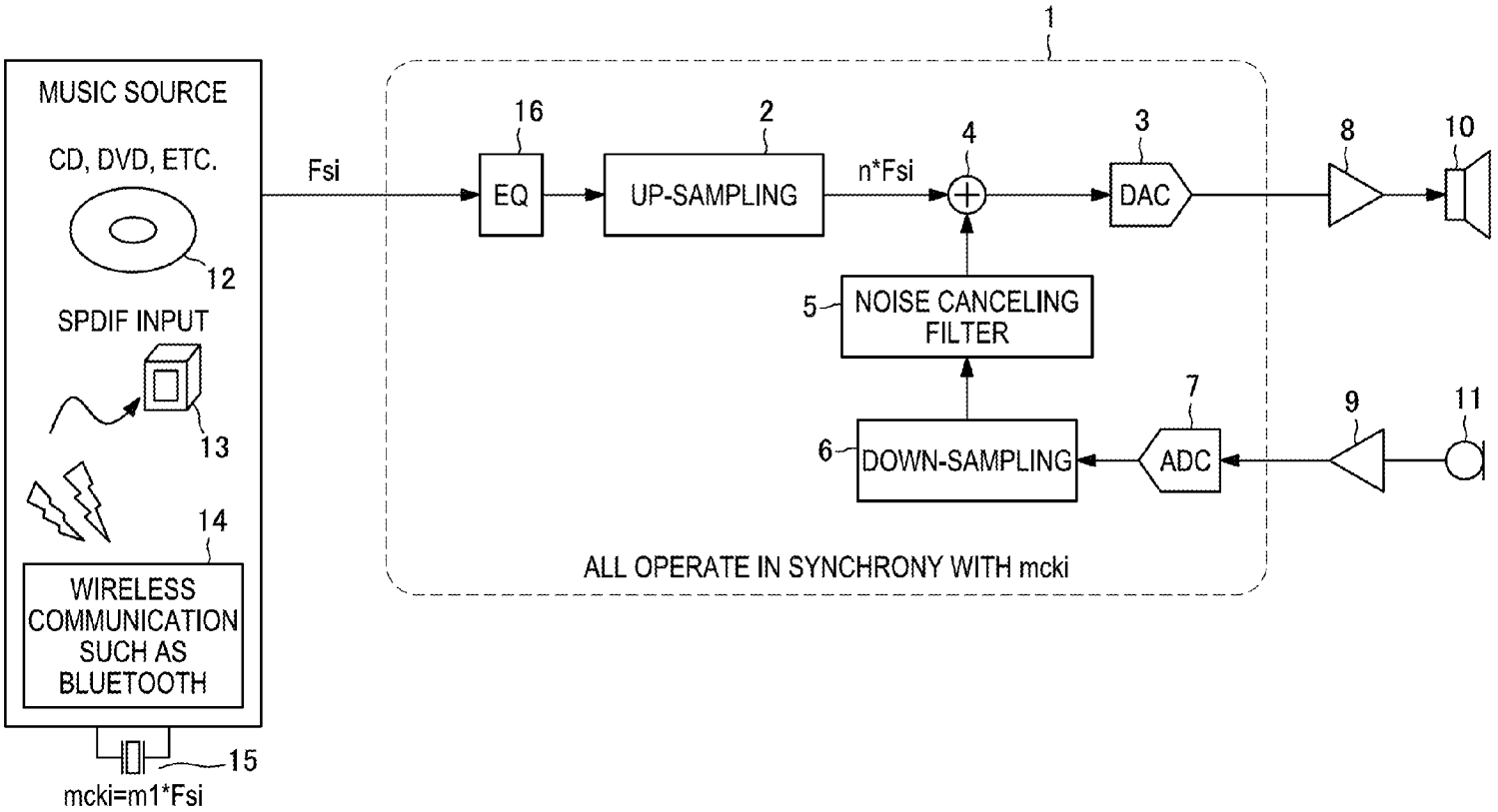
FIG. 4 is a diagram illustrating a specific example of using an equalizer.

In FIG. 4, the equalizer 16 directly receives the digital audio signal from the music source, performs cutting on a low frequency band of the signal or the like, and outputs the obtained signal to the up-sampling unit 2.

In this case, when the sampling frequency Fsi of the digital audio signal from the music source is changed, the property of the equalizer 16 should be changed accordingly to obtain the same property. That is, it is necessary to perform operations such as replacing the equalizer coefficients of the equalizer 16, restarting the device, and so forth.

Figure 5:
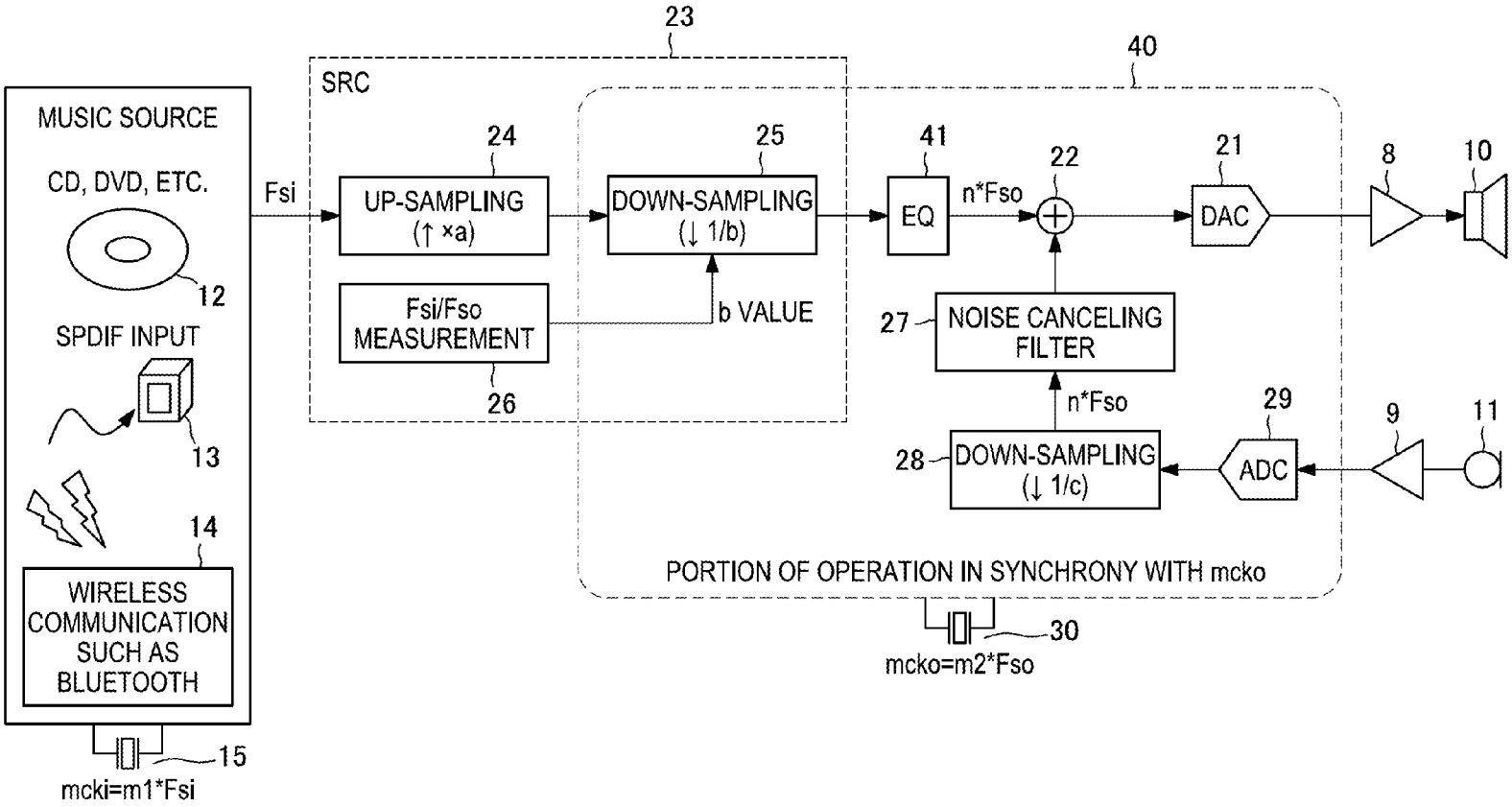
FIG. 5 is a diagram illustrating a second embodiment.

FIG. 5 is a diagram illustrating the second embodiment.

The signal processing device 40 of the present embodiment has an equalizer 41, and the signal processing device 40 itself has a master clock 30 and performs noise cancellation operation in synchrony with the master clock 30.

As shown in FIG. 5, the equalizer 41 is disposed between the SRC unit 23 and the addition unit 22. The digital audio signal sampled at the sampling frequency of n·Fso and output from the SRC unit 23 is subjected to low frequency-band cutting of the equalizer 41 or the like, and the obtained signal is input to the addition unit 22 and is added to the audio signal for cancellation.

In this case, since the signal process is performed based on n·Fso, it is not necessary to change the property of the equalizer 41 so as to match the change in sampling frequency Fsi of the digital audio signal from the music source. That is, it is not necessary to perform operations such as replacing the equalizer coefficients of the equalizer 41, restarting the device, and so forth.

<4. Third Embodiment>

Figure 6:
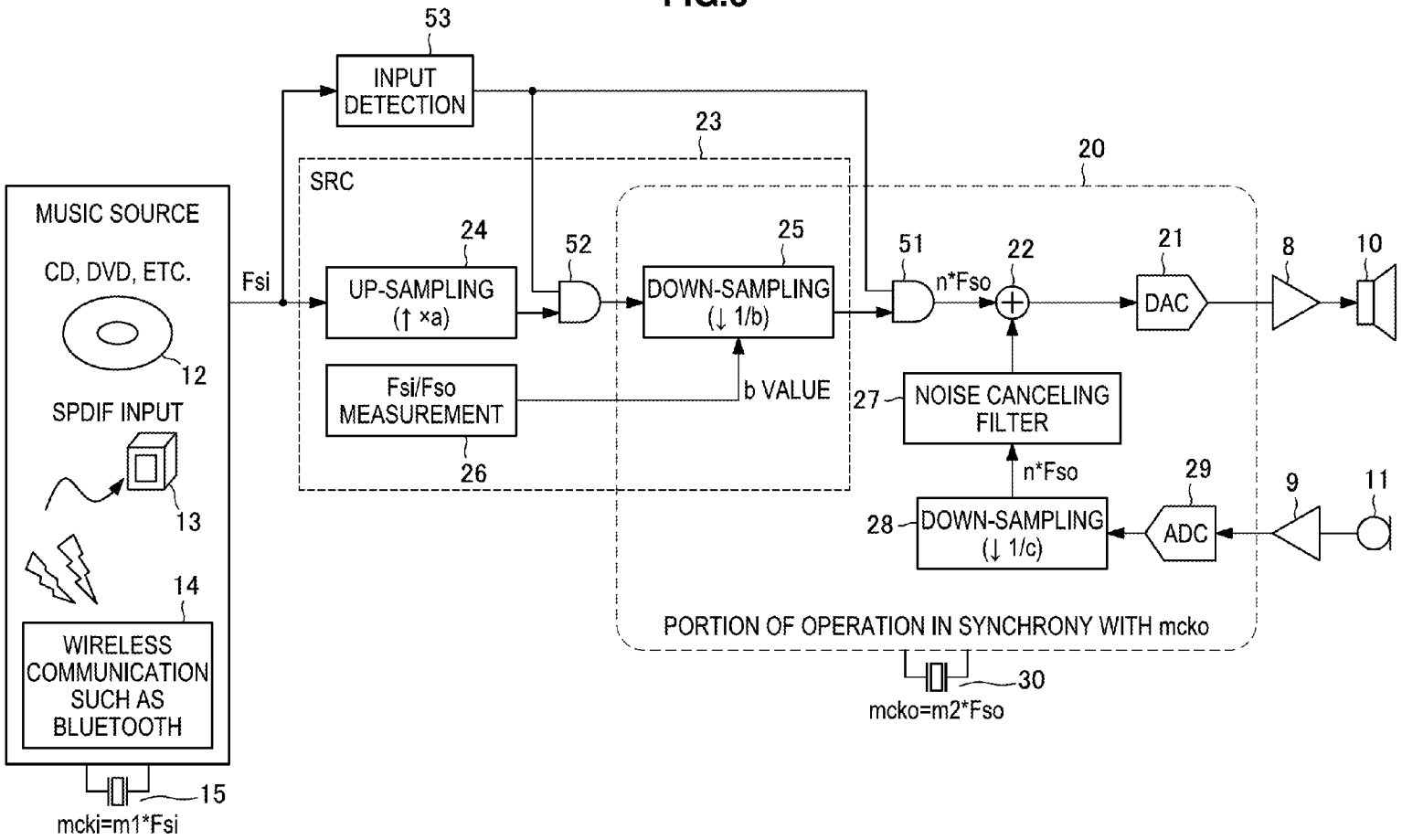
FIG. 6 is a diagram illustrating a third embodiment.

FIG. 6 is a diagram illustrating the third embodiment. The signal processing device 50 may independently have the master clock 30 to independently perform a noise cancellation function. The noise cancellation function can thus be carried out even when the input digital audio signal from the music source is interrupted.

Hereinafter, portions the same as those already described are denoted with the same reference symbols, and the redundant description is omitted.

As shown in FIG. 6, in the present embodiment, an input detection unit 53, a gate 52, and a gate 51 are added to the configuration described with reference to FIG. 3.

The input detection unit 53 is an example of a supply switching unit that performs switching on whether or not the digital audio signal output from the SRC unit 23 is supplied to the addition unit 22.

The input detection unit 53 detects whether or not the digital audio signal from the music source is present, and outputs a control signal (on or off) based on the presence or absence of the signal.

The gate 52 and the gate 51 block or connect the input signal, and output the input signal to an output terminal.

When an on-signal (for example, 1) is supplied as the control signal, each of the gate 52 and the gate 51 is turned on, and causes the signal (audio signal from the music source) input to one terminal to be output to an output terminal of each of the gates as it is.

On the other hand, when an off-signal (for example, 0) is supplied to the gate 52 and the gate 51 as the control signal, each of the gate 52 and the gate 51 is turned off, and causes the signal (audio signal from the music source) input to one terminal not to be output to the output terminal of each of the gates.

Accordingly, even when the input digital audio signal from the music source is interrupted, it is possible to maintain the connection state of the circuit as it is and to stably maintain the noise canceling effect.

In addition, any one or both of the gate 52 and the gate 51 may be employed.

Figure 7:
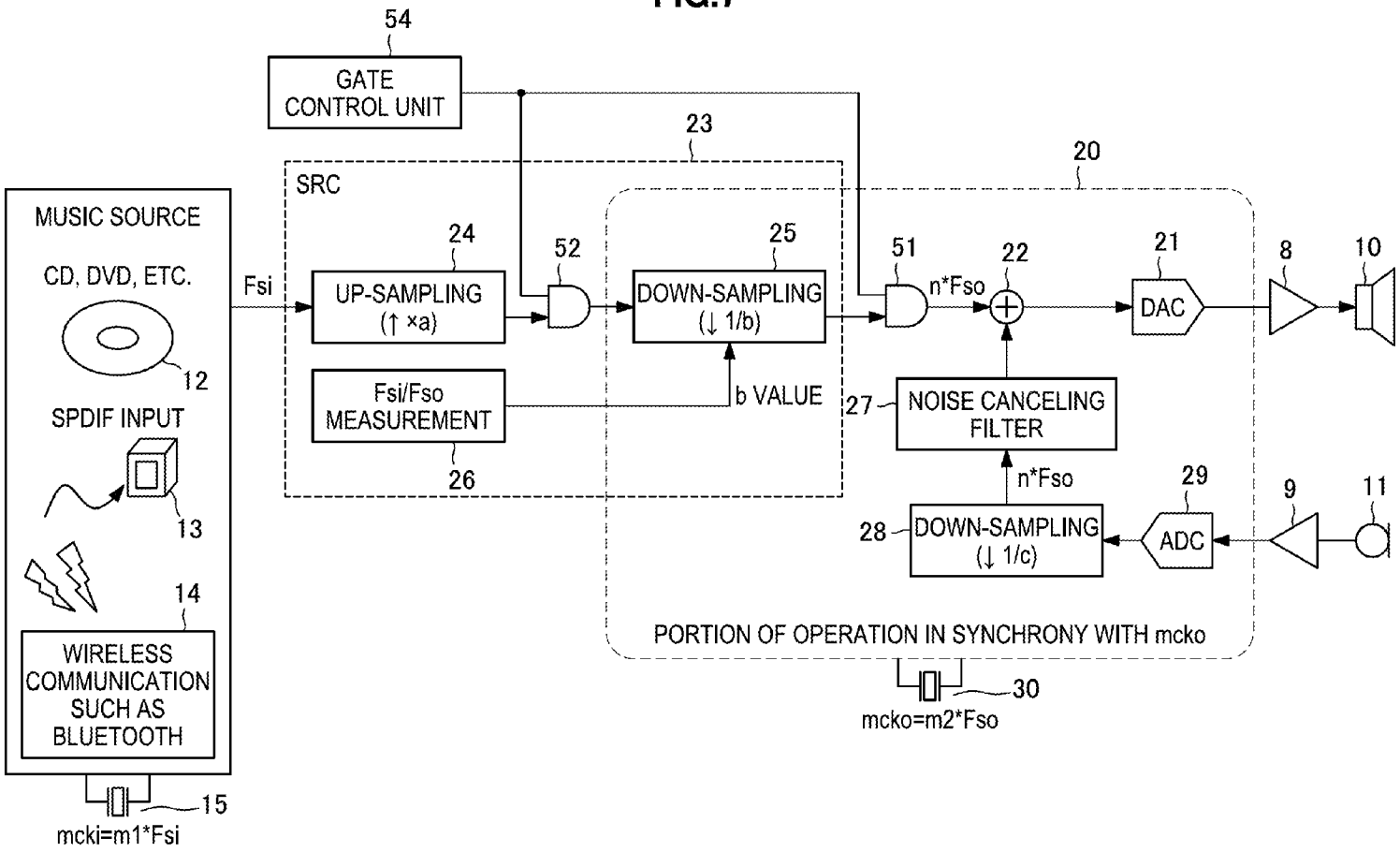
FIG. 7 is a diagram illustrating a modified example of the third embodiment.

FIG. 7 is a diagram illustrating a modified example of the third embodiment described above. In the modified example, an operation of independently carrying out the noise cancellation function is considered.

Hereinafter, the same portions as those already described are denoted with the same reference symbols, and the redundant description is omitted.

In this example, a gate control unit 54 is provided instead of the input detection unit 53 of FIG. 6. The gate control unit 54 is an example of a supply switching unit that performs switching on whether or not the digital audio signal output from the SRC unit 23 is supplied to the addition unit 22.

As shown in FIG. 7, the signal processing device 50 independently has the master clock 30. It is thus possible to carry out the noise cancellation function even when the digital audio signal from the music source is not input to the signal processing device 50. That is, it is possible to pick up external sounds (noises) from the microphone 11, obtain the audio signal passing through the amplifier 9, the ADC unit 29, and the down-sampling unit 28, perform a proper filtering process on the obtained audio signal, and generate an audio signal for cancellation. The audio signal for cancellation is then input to the addition unit 22. When the audio signal to be reproduced is not present, since the audio signal for cancellation has a phase opposite to a phase of the picked up external noise, the external sound is reduced when the audio signal synthesized in the addition unit 22 is audible from the speaker 10. In particular, external engine sounds or the like when the user is aboard an airplane, a car, and so forth can be reduced.

In FIG. 7, the gate control unit 54 outputs a control signal controlling whether or not the digital audio signal from the music source is supplied to the signal processing device 50 to the gate 52 and the gate 51. When an on-signal is supplied to the gate 52 and the gate 51 as the control signal, each of the gate 52 and the gate 51 is turned on, and causes the signal input to an input terminal to be output to an output terminal of each of the gates as it is.

It is possible to select between noise cancellation on the digital audio signal from the music source and noise cancellation based on absence of the digital audio signal from the music source by means of the gate 52 and the gate 51 under control of the gate control unit 54.

For example, when the gate control unit 54 outputs the control signal in response to the user operation, it is possible to exhibit a sound insulation effect by means of the noise cancellation operation when the user wearing the headphones having the microphone 10 and the microphone 11 wants the sound insulation effect without listening to music or the like.

In this case as well, any one or both of the gate 52 and the gate 51 may be employed.

<5. Fourth Embodiment>

Figure 8:
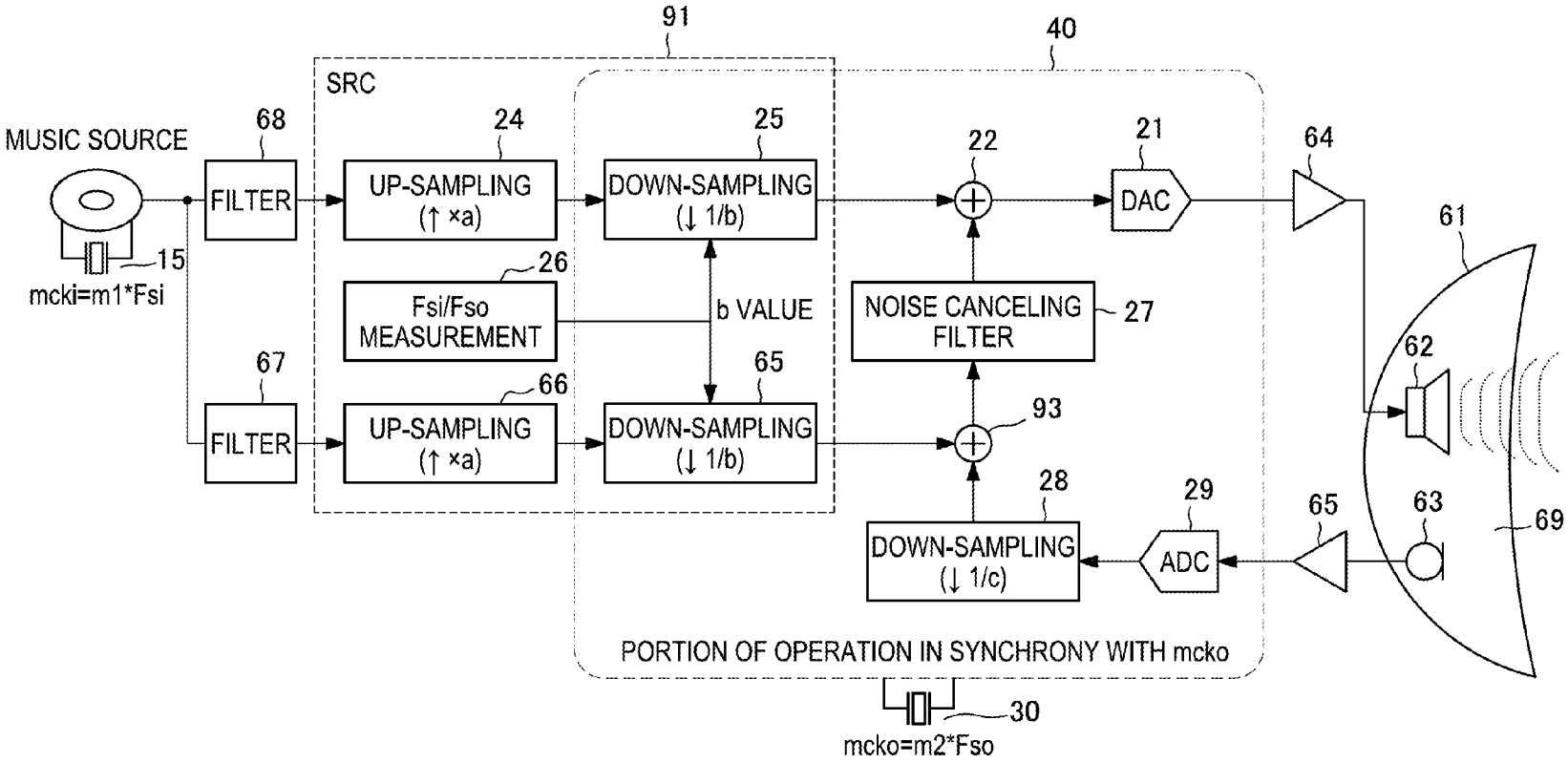
FIG. 8 is a diagram illustrating a fourth embodiment.

FIG. 8 is a diagram illustrating a signal processing device 60 according to the fourth embodiment.

The signal processing device 60 itself has the master clock 30, and a noise canceling system using the feedback method ensures a dynamic range by adding the digital audio signal from the music source before and after the noise canceling filter 27. In the feedback method, since the sound to be reproduced is picked up with the external noise from the microphone, ensuring the dynamic range causes the noise cancellation to be distinguished and effective.

Hereinafter, the same portions as those already described are denoted with the same reference symbols, and the redundant description is omitted.

As shown in FIG. 8, first, the headphones 69 are, for example, a so-called encapsulation type device that has a mounting unit 61 completely covering the ears of the user by encapsulating the ears. The headphones 69 have a speaker 62 (diaphragm unit) having a diaphragm for sound reproduction, and a microphone 63. The speaker 62 is disposed within the mounting unit 69. The analog signal output from the DAC unit 21 is then input to the speaker 62 via the amplifier 64, thereby outputting the sound.

In addition, the microphone 63 is disposed within the mounting unit 61 such that the operator causes an output sound from the speaker 62 and a sound outside the headphones 69 (external sound) to have a location relation close to the audible point.

In the embodiment of FIG. 8, an up-sampling unit 66, a down-sampling unit 65, filters 67 and 68, and an addition unit 93 are added to the configuration of FIG. 3.

That is, as the path at which the signal processing device 60 receives the digital audio signal from the music source, a path of the up-sampling unit 66 and the down-sampling unit 65 within the SRC unit 91 is added. The digital audio signal of which the sampling rate is converted to a frequency n·Fso in the up-sampling unit 66 and the down-sampling unit 65 is supplied to the addition unit 93. That is, the audio signal for cancellation output from the down-sampling unit 28 is superimposed on the digital audio signal from the music source via the path by the addition unit 93, and the superimposed signal is input to the noise canceling filter 27.

In FIG. 8, it is assumed that the microphone for picking up the noise is disposed within the case, that is, on the same side as the speaker in the feedback type noise canceling system. In this case, the music source signal is superimposed on the signal for noise cancellation in the same manner as the feed-forward method, but in this case, it is to be noted that the music source signal is also incorporated in the feedback system. In general, this superimposition is carried out after operations of the noise canceling filter 27 after a proper filter is applied to the music source signal. However, in this case, a filter close to a shape of the property approximately opposite to the noise canceling property is required, a filter having an extremely large gain is required when the noise canceling amount is increased, and the dynamic range of the system is thus damaged.

However, according to Japanese Laid-Open Patent Publication No. 2009-33309, as shown in FIG. 8, the music source signal passes through the proper filters 67 and 68 and is superimposed before and after the noise canceling filter 27, and it is thus possible to suppress the filter having an excessive gain from being used and to effectively increase the dynamic range of the system.

In addition, any one or both of the filters 68 and 67 may be employed to perform only gain adjustment rather than frequency adjustment by means of the filter.

In the present embodiment, the digital audio signal component of the input digital audio signal subjected to a first filtering process in the filter 68 is rate-converted in the SRC unit 91 (24, 25) and then superimposed on the noise cancellation signal in the addition unit 22. In addition, the digital audio signal component of the input digital audio signal subjected to a second filtering process in the filter 67 is rate-converted in the SRC unit 91 (66, 65) and then superimposed on the signal input to the noise canceling filter 27.

In addition, since the filtering process using the filters 68 and 67 is carried out based on the sampling frequency n·Fso on the signal processing device 60 side, the number of operations is small and the consuming power and processing load as a whole are properly small compared to the filtering process carried out based on the sampling frequency Fsi on the music source side.

<6. Fifth Embodiment>

FIG. 9 is a diagram illustrating a signal processing device 70 according to the fifth embodiment. The signal processing device 70 itself has the master clock 30, and applies the optimal frequency characteristic to the digital audio signal from the music source based on external noises picked up by the microphone 11.

Hereinafter, the same portions as those already described are denoted with the same reference symbols, and the redundant description is omitted.

As shown in (A) of FIG. 9, a 5-band equalizer unit 73, a 5-band level analysis unit 74, a down-sampling unit 71, and an up-sampling unit 72 are added to the embodiment of FIG. 3.

The 5-band equalizer unit 73 changes the frequency characteristic of the digital audio signal from the music source. Here, for example, the frequency of 0 to Fsi/2 is divided to five bands, and it is possible to increase or decrease the signal property of each band.

The up-sampling unit 72 and the down-sampling unit 71 within the SRC unit 92 have opposite properties of the down-sampling unit 25 and the up-sampling unit 24, respectively. That is, a relation $b/a=b'/a'$ is present.

The audio signal that is picked up by the microphone 11, passes through the amplifier 9, the ADC unit 29, and the down-sampling unit 28, and is sampled at the frequency of n·Fso, is first converted to a signal sampled at the sampling frequency of, for example, 256·Fso for the audio signal for cancellation by the up-sampling unit 72. The down-sampling unit 71 then carries out linear interpolation on data of 256·Fso sampling using the frequency ratio of Fsi/Fso to convert the data to a signal having the required sampling frequency Fsi.

The 5-band level analysis unit 74 analyzes the signal from the down-sampling unit 71 (that is, external noises picked up by the microphone 11), and can analyze on which band the signals are concentrated.

The equalizing property of the 5-band equalizer unit 73 is then variably controlled in response to the analysis result of the 5-band level analysis unit 74.

In the present embodiment, in addition to the configuration of FIG. 3, the SRC unit 92 converts the input audio signal including the external noises picked up by the microphone to the signal sampled at a sampling frequency in synchrony with the sampling frequency of the digital audio signal input from the music source. Accordingly, the 5-band level analysis unit 74 analyzing the frequency characteristic of the rate-converted signal, and the 5-band equalizer unit 73 changing the frequency characteristic of the digital audio signal input based on the analysis result are thus configured.

(B) of FIG. 9 is a diagram visually illustrating the control state of the 5-band equalizer unit 73. As shown in (B), it is possible to change the sound level for each band.

(C) of FIG. 9 is a diagram illustrating a frequency characteristic of the audio signal picked up by the microphone 11 for each of 5 bands.

Here, for example, when the level of the noise cancellation signal in any band is higher than that in other bands, the level of the band of the 5-band equalizer unit 73 is controlled toward the boost direction in response to the higher band, while the level of the band of the 5-band equalizer unit 73 is controlled toward the cut direction, and it is thus possible to have the noise canceling effect in an optimal sate.

When the low frequency-band component is specified and analyzed while analyzing the noise level, decimation of ½, ¼, and so forth may also be carried out within the 5-band level analysis unit 74.

In addition, the configuration above is not limited to the example of dividing the band in five.

In addition, the 5-band level analysis unit 74 operates in synchrony with the mcki period, but can always use the same band level analysis result and the equalizer coefficient regardless of the mcki/mcko relation.

<7. Sixth Embodiment>

Figure 10:
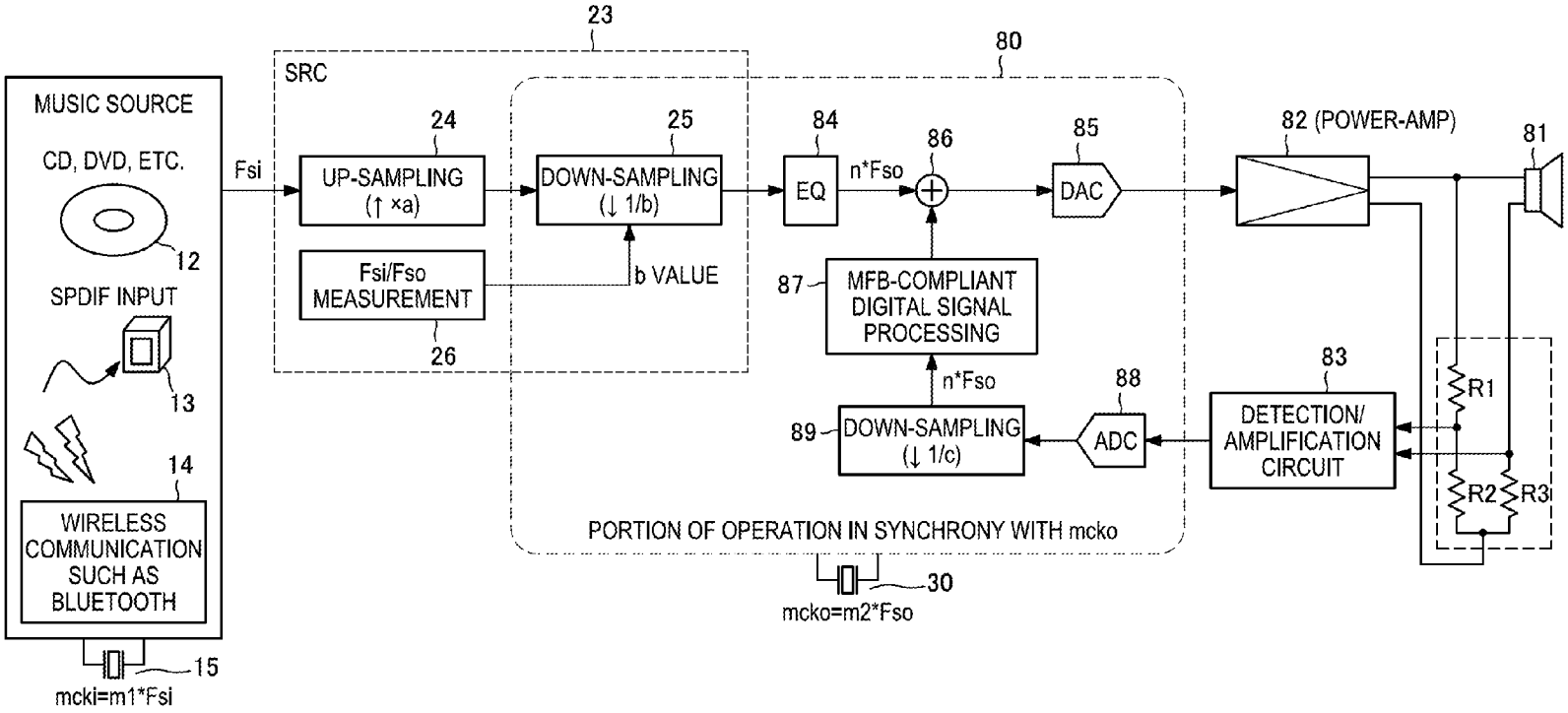
FIG. 10 is a diagram illustrating a sixth embodiment.

FIG. 10 is a diagram illustrating a signal processing device 80 according to the sixth embodiment. The present disclosure of causing the signal processing device 80 itself to have the master clock 30 is applied to a motional feedback (MFB) process.

Hereinafter, the same portions as those already described are denoted with the same reference symbols, and the redundant description is omitted.

MFB is a technique of detecting motion of the diaphragm of a speaker unit, applying a negative feedback to an input audio signal, and for example, causing the diaphragm of the speaker unit and the input audio signal to have the same movement. Accordingly, for example, vibration near a low-band resonant frequency f0 is damped, and undesired influences on the low frequency-band such as boomy bass are thus suppressed on the sense of hearing.

As shown in FIG. 10, the MFB process system may include an equalizer 84, an addition unit 86, an MFB-compliant digital signal processing unit 87, a DAC unit 85, a power amplifier 82, a speaker (diaphragm unit) 81, a bridge circuit 90, a detection/amplification circuit 83, and an ADC unit 88.

The digital audio signal from the music source passes through the up-sampling unit 24 and the down-sampling unit 25, is converted with respect to the sampling frequency, and becomes a digital audio signal having the frequency sampled at the frequency n·Fso. The digital audio signal is, for example, input to the equalizer 84. The equalizer 84 performs low frequency-band correction. The equalizer 84 then performs low frequency-band compensation on the reproduction sound from the speaker 81 to which MFB is applied so as to obtain the desired frequency characteristic.

The digital audio signal output from the equalizer 84 is output to the addition unit 86. The addition unit 86 applies a negative feedback to the input audio signal, and synthesizes the input digital audio signal with an inverted feedback signal of the feedback signal output from the MFB-compliant digital signal processing unit 87.

In this case, the digital audio signal is input to the DAC unit 85 as an output of the addition unit 86. The DAC unit 85 converts the input digital audio signal to an analog signal.

The power amplifier 82 amplifies the analog audio signal from the DAC unit 85, and supplies the amplified analog audio signal to a voice coil of the speaker 81 as a driving signal. The sound of the music source is thus reproduced from the speaker 81.

The bridge circuit 90 connects resistors R1, R2, and R3 to the line of the driving signal from the power amplifier 82 to the speaker 81 as shown in FIG. 10. The detection/amplification circuit 83 receives a signal from a sensor part as the bridge circuit 90 as an input, and generates a detection signal in response to a speed of movement of the speaker 81 as the movement of the speaker.

In this case, the analog detection signal output from the detection/amplification circuit 83 is converted to a digital signal by the ADC unit 88, and is converted to a signal sampled at a frequency of n·Fso by the down-sampling unit 89. The signal is input to the MFB-compliant digital signal processing unit 87.

The MFB-compliant digital signal processing unit 87 corresponds to a signal processing system as a so-called feedback circuit, and generates a feedback signal from the input digital detection signal.

As described above, the input audio signal is applied with the negative feedback in response to the movement of the diaphragm of the speaker 81, and the speaker 81 is driven by an amplified output of the audio signal to which the negative feedback is applied.

The MFB control system thus controls the speaker 81 to reliably vibrate in response to a waveform of the input audio signal. This is the operation, for example, applying damping centered on the low-band resonant frequency f0, and undesired influences on the low frequency-band are thus suppressed and the reproduction sounds are improved as described above.

In addition, according to the present embodiment, even when the sampling frequency of the digital audio signal of the music source is changed, the MFB processing system that does not need to change the property of the MFB-compliant digital signal processing unit 87 and the frequency characteristic of the equalizer 84 can be realized.

In addition, the present disclosure may employ the following configurations.

(1) A signal processing device including:

a noise cancellation process clock generation unit configured to generate a clock having a predetermined fixed frequency for a noise cancellation process;

a noise canceling unit configured to include a noise canceling filter operating based on the noise cancellation process clock and generating a noise canceling signal having a signal property of canceling an external noise component based on an input audio signal including the external noise component picked up by a microphone, and an addition unit superimposing the noise canceling signal generated by the filter on a digital audio signal; and a sampling rate conversion unit configured to rate-convert the input digital audio signal sampled at a clock in asynchrony with the noise cancellation process clock to a signal at a sampling frequency in synchrony with the noise cancellation process clock and to supply the rate-converted signal to the addition unit.

(2) The device according to (1), wherein the sampling rate conversion unit includes an up-sampling unit configured to raise the sampling frequency of the input digital audio signal, and a down-sampling unit configured to lower the sampling frequency raised by the up-sampling unit to a frequency based on the noise cancellation process clock.

(3) The device according to (1) or (2), wherein the noise canceling unit further includes an external noise digitization processing unit configured to convert the input audio signal including the external noise component picked up by the microphone to a digital signal in synchrony with the frequency of the noise cancellation process clock and to supply the converted digital signal to the noise canceling filter.

(4) The device according to any one of (1) to (3), further including:

an equalizer unit configured to change a frequency characteristic of the digital audio signal output from the sampling rate conversion unit.

(5) The device according to any one of (1) to (4), further including:

a supply switching unit configured to switch whether or not the digital audio signal output from the sampling rate conversion unit is supplied to the addition unit.

(6) The device according to any one of (1) to (3), wherein a digital audio signal component obtained by subjecting the input digital audio signal to a first filtering process is rate-converted by the sampling rate conversion unit, and then the addition unit superimposes the noise cancellation signal on the digital audio signal, and a digital audio signal component obtained by subjecting the input digital audio signal to a second filtering process is rate-converted by the sampling rate conversion unit, and then an input signal to the filter of the noise cancellation unit is superimposed on the digital audio signal component.

(7) The device according to any one of (1) to (3), wherein the sampling rate conversion unit rate-converts the input audio signal including the external noise component picked up by the microphone to a signal sampled at a sampling frequency in synchrony with the sampling frequency of the input digital audio signal, and the device further includes:

a signal analysis unit configured to analyze a frequency characteristic of the rate-converted signal; and a band equalizer configured to change the frequency characteristic of the digital audio signal input based on a result obtained by the signal analysis unit.

(8) The device according to any one of (1) to (7), wherein the input digital audio signal is a digital audio signal reproduced from a recording medium.

(9) The device according to any one of (1) to (7), wherein the input digital audio signal is a digital audio signal transmitted in a wired or wireless communication manner from an external apparatus.

It should be understood by those skilled in the art that various modifications, combinations, sub-combinations and alterations may occur depending on design requirements and other factors insofar as they are within the scope of the appended or the equivalents thereof.

The present disclosure contains subject matter related to that disclosed in Japanese Priority Patent Application JP 2011-126125 filed in the Japan Patent Office on Jun. 6, 2011, the entire content of which is hereby incorporated by reference.

What is claimed is:

1. A signal processing device comprising:

a noise cancellation process clock generation processor configured to generate a noise cancellation process clock having a predetermined fixed frequency;

a noise canceling processor configured to include a noise canceling filter operating based on the noise cancellation process clock and generating a noise canceling signal having a signal property of canceling an external noise component based on an input audio signal including the external noise component picked up by a microphone, a sampling rate conversion processor configured to rate-convert the input digital audio signal sampled at a clock in asynchrony with the noise cancellation process clock to a signal at a sampling frequency in synchrony with the noise cancellation process clock; and an addition processor superimposing the noise canceling signal generated by the filter on the rate-converted digital audio signal;

wherein the sampling rate conversion processor includes:

an up-sampling unit configured to raise the sampling frequency of the input digital audio signal, and a down-sampling unit configured to lower the sampling frequency raised by the up-sampling unit to a frequency based on the noise cancellation process clock.

2. The signal processing device according to claim 1, wherein the noise canceling processor further includes an external noise digitization processing unit configured to convert the input audio signal including the external noise component picked up by the microphone to a digital signal in synchrony with the frequency of the noise cancellation process clock and to supply the converted digital signal to the noise canceling filter.

3. The signal processing device according to claim 1, further comprising:

an equalizer unit configured to change a frequency characteristic of the digital audio signal output from the sampling rate conversion processor.

4. The signal processing device according to claim 1, further comprising:

a supply switching unit configured to switch whether or not the digital audio signal output from the sampling rate conversion processor is supplied to the addition unit.

5. The signal processing device according to claim 1, wherein a digital audio signal component obtained by subjecting the input digital audio signal to a first filtering process is rate-converted by the sampling rate conversion processor, and then the addition unit superimposes the noise cancellation signal on the digital audio signal, and a digital audio signal component obtained by subjecting the input digital audio signal to a second filtering process is rate-converted by the sampling rate conversion processor, and then an input signal to the filter of the noise cancellation processor is superimposed on the digital audio signal component.

6. The signal processing device according to claim 1, wherein the sampling rate conversion processor rate-converts the input audio signal including the external noise component picked up by the microphone to a signal sampled at a sampling frequency in synchrony with the sampling frequency of the input digital audio signal, and the signal processing device further comprises:

a signal analysis unit configured to analyze a frequency characteristic of the rate-converted signal; and a band equalizer configured to change the frequency characteristic of the digital audio signal input based on a result obtained by the signal analysis unit.

7. The signal processing device according to claim 1, wherein the input digital audio signal is a digital audio signal reproduced from a recording medium.

8. The signal processing device according to claim 1, wherein a digital audio signal to be input is a digital audio signal transmitted in a wired or wireless communication manner from an external apparatus.

9. A signal processing method comprising:

generating a noise cancellation signal having a signal property of canceling an external noise component based on an input audio signal including the external noise component picked up by a microphone in a filtering process based on a noise cancellation process clock having a predetermined fixed frequency;

rate-converting an input digital audio signal sampled at a clock in asynchrony with the noise cancellation process clock to a signal having a sampling frequency in synchrony with the noise cancellation process clock; and adding the noise cancellation signal to the rate-converted digital audio signal;

wherein the rate converting includes raising a sampling frequency of the input digital audio signal and lowering the sampling frequency of the input digital audio signal to a frequency based on the noise cancelation process clock.

* * * * *